US005369473A

United States Patent [19]

Ogawa et al.

[11] Patent Number: 5,369,473

[45] Date of Patent: Nov. 29, 1994

[54] IMAGE FORMING APPARATUS

[75] Inventors: Kazuhiro Ogawa; Kazuto Hori, both of Osaka, Japan

[73] Assignee: Mita Industrial Co., Ltd., Osaka, Japan

[21] Appl. No.: 67,210

[22] Filed: May 24, 1992

[30] Foreign Application Priority Data

May 27, 1992 [JP] Japan ..... 4-135140

[51] Int. Cl.[5] ..... G03G 21/00; G03G 15/00

[52] U.S. Cl. ..... 355/214; 355/208; 355/246

[58] Field of Search ..... 355/203, 204, 208, 246, 355/214; 118/688-691

[56] References Cited

U.S. PATENT DOCUMENTS

| | | | |
|---|---|---|---|
| 4,248,527 | 2/1981 | Akiyama et al. | 355/246 |
| 4,272,182 | 6/1981 | Abe et al. | 355/246 |
| 4,632,537 | 12/1986 | Imai | 355/203 |
| 4,647,184 | 3/1987 | Russel et al. | 355/208 |
| 4,678,317 | 7/1987 | Grossinger | 355/246 X |
| 4,975,747 | 12/1990 | Higuchi | 355/246 |
| 5,060,013 | 10/1991 | Spence | 355/208 |
| 5,099,279 | 3/1992 | Shimizu | 355/208 |
| 5,103,261 | 4/1992 | Tompkins et al. | 355/208 |
| 5,151,740 | 9/1992 | Fujimoto | 355/246 |
| 5,181,071 | 1/1993 | Nakajima et al. | 355/203 |
| 5,182,596 | 1/1993 | Nakazawa et al. | 355/203 |
| 5,253,018 | 10/1993 | Takeuchi et al. | 355/246 |
| 5,296,895 | 3/1994 | Naito | 355/208 |

*Primary Examiner*—Matthew S. Smith
*Attorney, Agent, or Firm*—Jordan & Hamburg

[57] ABSTRACT

An image forming apparatus is provided with a rotatable photosensitive member; an imaging assembly for exposing the surface of the photosensitive member to light so as to form an electrostatic latent image thereon and developing the electrostatic latent image; and a sensor arranged in the vicinity of and opposed to the surface of the photosensitive member, and adapted for detecting an imaging performance in a specific region on the surface of the photosensitive member. With the image forming apparatus thus constructed, measurement values vary only within a reduced range since an imaging performance of the photosensitive member is detected in a specific region on the photosensitive member.

17 Claims, 17 Drawing Sheets

IMAGE FORMING APPARATUS

BACKGROUND OF THE INVENTION AND RELATED ART STATEMENT

This invention relates to an image forming apparatus such as a copying machine and a printer and, more particularly to an image forming apparatus capable of detecting an imaging performance of a photosensitive member by the use of a sensor arranged in the vicinity of and opposed to a rotating surface of the photosensitive member.

In a copying machine, printer, or like image forming apparatus, it is extremely important in setting imaging conditions including a charged amount and an exposure amount to detect and grasp an imaging performance of the photosensitive member. Generally, data indicative of the imaging performance of the photosensitive member include the density of a toner image formed on the photosensitive member (toner density), a level of potential on the surface of the photosensitive member charged by a charger, etc.

In conventional image forming apparatuses, the toner density is detected by sensor arranged in a position in the vicinity of and opposed to the circumferential surface of the photosensitive member rotating at a constant speed. This sensor detects the toner density of the toner image in a specified region after the toner image is formed on the photosensitive member.

Here will be described the detection of the toner density of the toner image formed on the photosensitive member in the conventional image forming apparatus with reference to FIGS. 17A to 17C. FIG. 17A is a graph showing a sensor output over time when the toner density is detected while the photosensitive member is stationary. FIG. 17B is a graph showing a sensor output over time when the toner density is detected while the photosensitive member is rotating. FIG. 17C is a graph showing a sensor output when a sampling is made continuously so as to measure the toner density while the photosensitive member is rotating.

When the photosensitive member is stationary, the toner density is detected at an arbitrary point on the surface of the photosensitive member. Accordingly, the sensor output varies only due to variations in detection performance and output performance of the sensor itself. Thus, the sensor output does not vary greatly as seen from FIG. 17A. Contrary to this, when the photosensitive member is rotating, other detecting conditions change in addition to the variations of the sensor itself. These conditions include a change in a distance between the photosensitive member and the sensor due to the nonuniformity of the surface of the photosensitive member and according to the rotation of the photosensitive member, etc. The changes in these conditions cause the change in the sensor output over time as shown in FIG. 17B. It will be appreciated that the photosensitive member makes one turn during a period defined by time t12 and time t13 in FIG. 17B. Accordingly, if the toner density is measured a plurality of times (e.g. 100 times) in the above conventional image forming apparatuses, the sensor output varies greatly as shown in FIG. 17C.

In the conventional image forming apparatuses, when an optical system is caused to scan the same document a plurality of times, the optical system is controllably driven lest it should start an exposing operation from the same position with respect to rotating direction of the circumferential surface of the photosensitive member so as to prevent the deterioration of the surface of the photosensitive member, or the like. In other words, even when the toner density is measured a plurality of times using the same document, the exposure start position on the photosensitive member is not fixed. Thus, in the conventional image forming apparatuses in which the toner density is measured in the specified region on the photosensitive member, the toner density may not be necessarily measured at the same position on the photosensitive member. Thus, the measurement values may vary due to the fact that the measurement is made at different positions.

In view of the foregoing, when the toner density is measured while the photosensitive member is rotating, it is necessary to handle as errors the variations in the measurement values due to the different measurement positions in addition to the variations of the sensor itself. Accordingly, it is extremely difficult to set the respective imaging conditions so as to provide stable images in accordance with the toner density detected in the conventional image forming apparatuses.

Likewise, even when the potential is measured so as to use the potential on the surface of the photosensitive member charged by the charger as a data indicative of the imaging performance of the photosensitive member, the measurement values varies due to the different measurement positions.

SUMMARY OF THE INVENTION

In view of the problems residing in the prior art, it is an object of the invention to provide an image forming apparatus capable of detecting an imaging performance reliably without being influenced by changes in detecting conditions according to the rotation of a photosensitive member.

Accordingly, the invention is directed to an image forming apparatus comprising a rotatable photosensitive member; imaging means for exposing the surface of the photosensitive member to light so as to form an electrostatic latent image thereon and developing the electrostatic latent image; and first detecting means arranged in the vicinity of and opposed to the surface of the photosensitive member, and adapted for detecting an imaging performance in a specific region on the surface of the photosensitive member.

The imaging means may preferably include developing means for developing the electrostatic latent image into a toner image by supplying toner to the photosensitive member, and the first detecting means may detect the toner density of the toner image formed on the photosensitive member.

Alternatively, the imaging means may include a charging means for charging the photosensitive member, and the performance detector means may detect the potential of the photosensitive member charged by the charging means.

With the image forming apparatus thus constructed, the rotating photosensitive member is exposed to the light and the electrostatic latent image is formed and developed into the toner image. Thereafter, the imaging performance of the photosensitive member is detected so as to set imaging conditions including an exposure amount and charged amount. At this time, since the imaging performance is detected constantly in the specific region on the photosensitive member, the measurement values vary within a reduced range.

The image forming apparatus according to the invention may further comprise second detecting means for detecting a position on the surface of the photosensitive member. The second detecting means may advantageously includes a reference position indicating portion for indicating a reference position of the photosensitive member, detector means for detecting the reference position indicating portion, and timer means for measuring time. In this apparatus, the first detecting means may operate only for a specified period after the detection of the reference position.

With this arrangement, the imaging performance is detected in the region which rotates constantly from the reference position of the photosensitive member for the specified period.

Alternatively, the second detecting means may include first and second position indicating portions for indicating positions of the photosensitive member and detector means for detecting the first and second position indicating portions. In this apparatus, the first detecting means may operate until the second position indicating portion is detected after the detection of the first position indicating portion.

With this arrangement, the imaging performance is detected constantly in the region defined between the first and second position indicating portions.

The image forming apparatus may also comprise third detecting means for detecting that the photosensitive member has made one turn. In this apparatus, the first detecting means may operate only while the photosensitive member makes one turn.

With this arrangement, the imaging performance is detected constantly over an entire circumferential surface of the photosensitive member.

These and other objects, features and advantages of the present invention will become more apparent upon a reading of the following detailed description and accompanying drawings.

DETAILED DESCRIPTION OF THE PREFERRED EMBODIMENTS OF THE INVENTION

Figure 1:
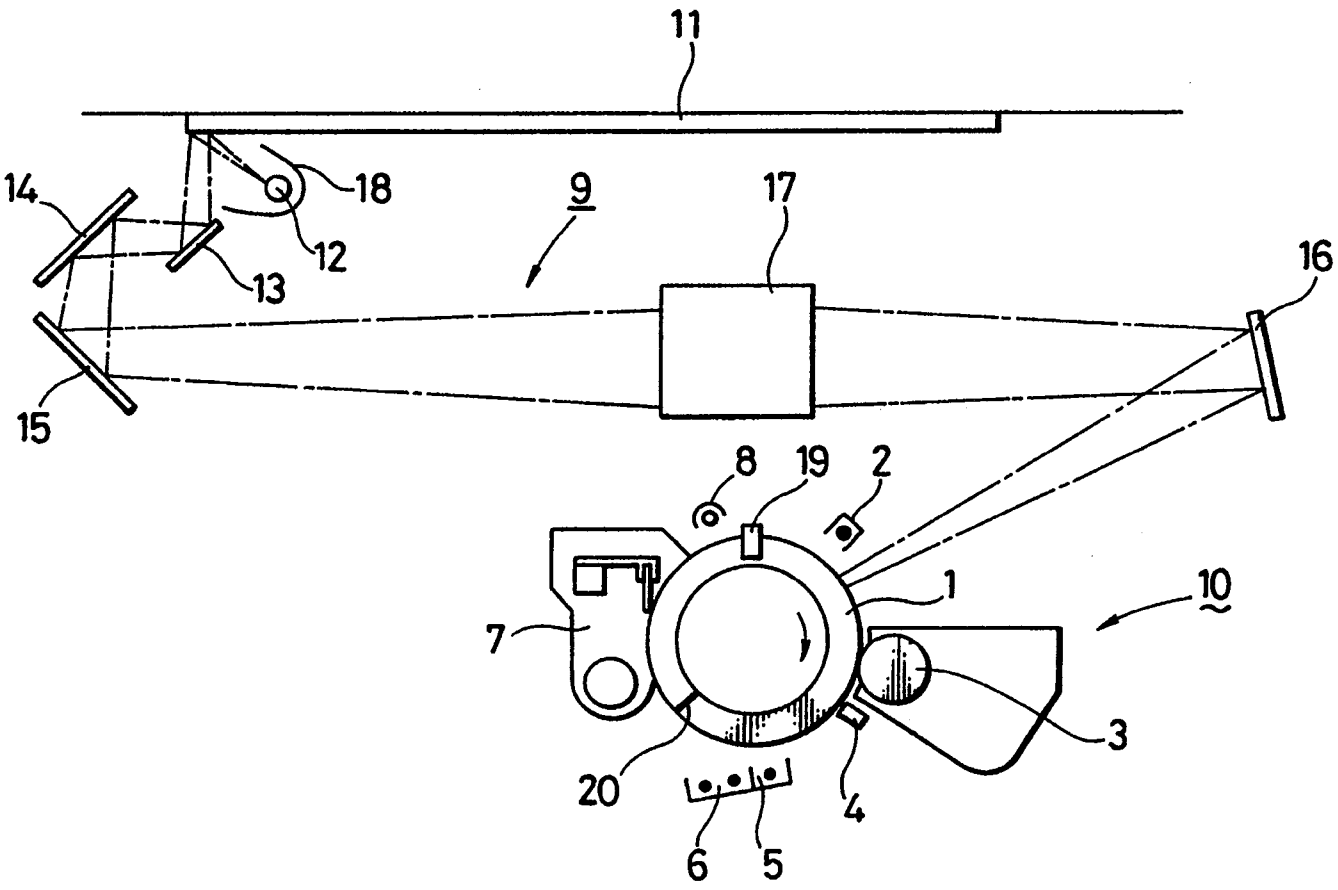
FIG. 1 is a schematic construction diagram showing an essential portion of a first copying apparatus embodying the invention.
Figure 2:
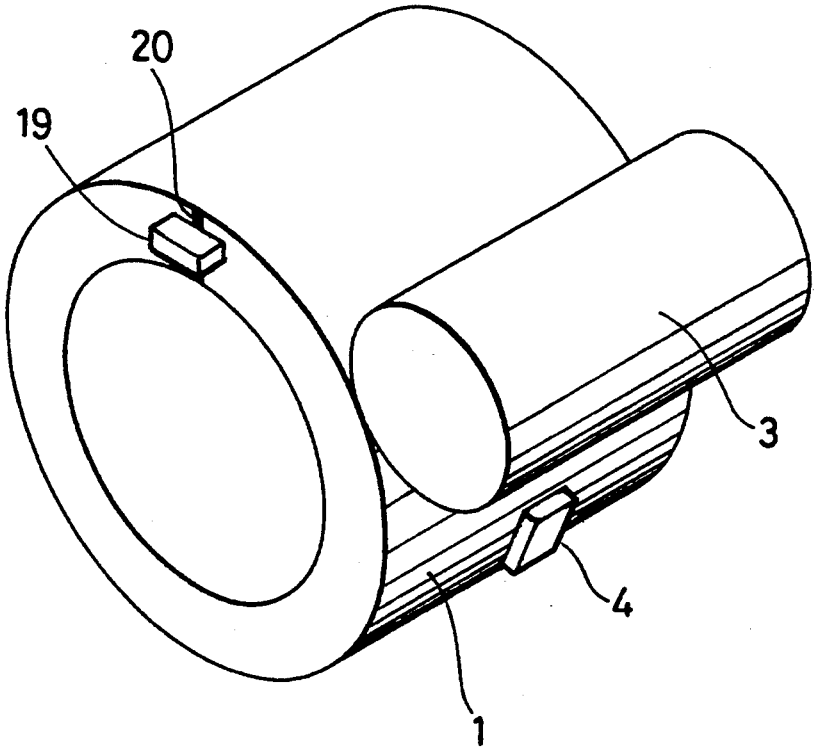
FIG. 2 is a perspective view showing a positional relationship between a photosensitive drum and a sensor in the first embodiment.

A first image forming apparatus embodying the invention will be described with reference to FIGS. 1 to 6. A construction of the first embodiment will be described first with reference to FIGS. 1 and 2. FIG. 1 is a schematic construction diagram showing an essential portion of a copying machine as the first embodiment of the invention, and FIG. 2 is a perspective view showing a positional relationship between a photosensitive drum and a sensor.

This copying machine is provided with a transparent document platen 11 on which a document is placed, an optical assembly 9 and an imaging assembly 10 below the document platen 11.

The optical assembly 9 is provided with a halogen lamp 12, a light source unit including a reflecting mirror 18, reflecting mirrors 13 to 16, a focusing lens 17, etc. The imaging assembly 10 is provided with a photosensitive drum 1, a charger 2, a developing device 3, a sensor 4, a transfer device 5, a separation device 6, a cleaner 7, and a charge removal lamp 8 arranged in this order from an upstream side along a circumferential surface of the drum 1. The charger 2 charges the surface of the drum 1 at a specified potential. The developing device 3 develops an electrostatic latent image into a toner image. The sensor 4 detects a state concerning an imaging performance. The transfer device 5 transfers the toner image formed on the drum 1 to a copy sheet. The cleaner 7 removes the toner residual on the drum 1. The charge removal lamp 8 removes the charges residual on the drum 1.

The sensor 4 is arranged in a suitable position in the vicinity of and opposed to the surface of the drum 1 and includes, for example, an optical sensor. The sensor 4 detects the toner density of the toner image which is developed on the surface of the drum 1 by the developing device 3. More specifically, the sensor 4 is capable of detecting the toner density over an entire circumferential surface of the drum 1 within a specified region determined along an axial direction of the drum 1 while the drum 1 rotates. The sensor 4 of any type will do provided that it detects the state concerning the imaging performance. For example, the sensor 4 may detect the potential of the drum 1 charged by the charger 2.

On a side surface of the drum 1 is provided a rotation reference position indicia 20 defined by a marking or the like as shown in FIG. 2. A position sensor 19 is arranged away from the drum 1 by a very small distance along the axial direction of the drum 1 so as to detect the rotation reference position indicia 20. This position sensor 19 includes, for example, a reflection type optical sensor. The position sensor may include a magnet and a reed switch.

In the copying machine thus constructed, the light emitted from the halogen lamp 12 is reflected by a document surface, and the reflected light image is projected onto the surface of the drum 1 through the reflecting mirrors 13 to 15, the focusing lens 17, and the reflecting mirror 16. While rotating in an arrow direction of FIG. 1, the drum 1 has the surface thereof exposed to the light representing a document image after being charged at the specified potential by the charger 2. In this way, the electrostatic latent image is formed on the surface of the drum 1.

Figure 3:
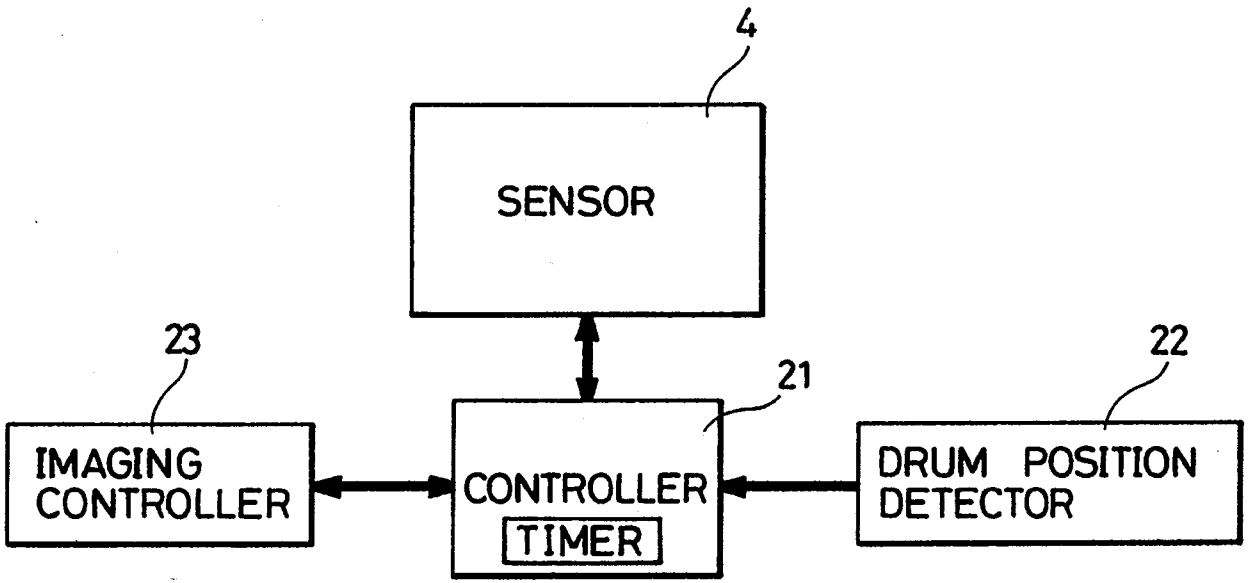
FIG. 3 is a block diagram showing a control system of the first copying machine.

A control system of the copying machine will be described next with reference to a block diagram shown in FIG. 3.

A controller 21 includes a microcomputer or the like, and controls an operation of this copying machine. The controller 21 includes a timer used to detect the position of the sensor 4 with respect to the circumferential direction of the drum 1. The controller 21 renders the toner density detected by the sensor 4; carries out the computation using the detected data; and sets necessary imaging conditions based on the computation result.

A drum position detector 22 consists essentially of the position sensor 19 and the rotation reference position indicia 20. The detector 22 detects the rotation reference position indicia of the drum 1, and outputs a detection signal to the controller 21. The controller 21 causes the timer to start a time measuring operation upon the receipt of the detection signal from the drum position detector 22 so as to detect the rotational position of the drum 1.

An imaging controller 23 controls in response to a control signal from the controller 21 such that a charging operation or an exposing operation with a specified light amount is started from a preset position on the drum 1 when the rotation reference position indicia 20 of the drum 1 is detected by the drum position detector 22.

Figure 4:
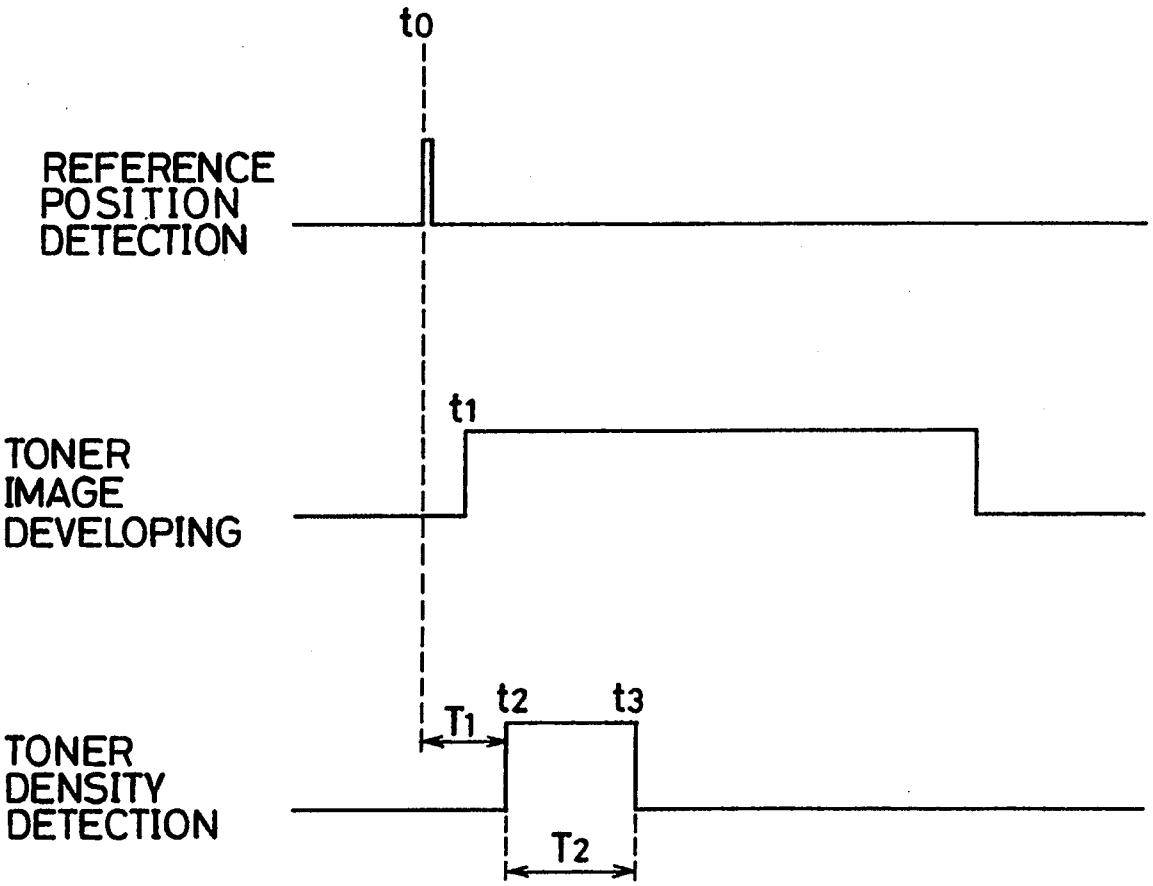
FIG. 4 is a timing chart showing a procedure of measuring the toner density in the first embodiment.

There will be described a measurement procedure of the sensor 4 next with reference to a timing chart shown in FIG. 4. The toner density measurement is made using a special test document carrying an image of, for example, a reference density, and is started by operating an operation key such as an image density measurement mode key.

When the operation key is operated, the drum 1 starts rotating and the rotation reference position indicia 20 is detected at time t0 by the position sensor 19 which sends a detection signal to the controller 21. Upon the receipt of the detection signal, the controller 21 sends a control signal to the imaging controller 23 to form a test document image on the drum 1. In response to this control signal, the surface of the drum 1 is charged at the specified potential by the charger 2, and the optical assembly 9 is caused to scan so as to start the formation of an electrostatic latent image on the drum 1.

After the electrostatic latent image is developed by the developing device 3 at time t1, the sensor 4 starts detecting the toner density of the toner image formed on the drum 1 at time t2 after the lapse of a period T1 following time t0. The toner density detection is completed at time t3 after the lapse of a period T2 following time t2. The sensor 4 detects the toner density in synchronism with a clock signal from the controller 21 to produce a plurality of discrete toner density data during the period T2. These discrete density data are output to the controller 21 to be averaged, and an average value is used as a measurement data. This measurement data is displayed, for example, in an unillustrated operation panel of the copying machine, and the controller 21 sets the imaging conditions including the charge amount and the exposure amount based on this measurement data.

The period T1 which lasts until the sensor 4 starts detecting the toner density (time t2) after the position sensor 19 detects the rotation reference position indicia 20 (time t0) and the period T2 which lasts until the sensor 4 completes the detection (time t3) after the time t2 are preset by the controller 21 in accordance with a positional relationship of the position sensor 19, the exposure position on the drum 1, the developing device 3, and the sensor 4. These periods are measured using the timer provided in the controller 21.

More specifically, the rotating speed of the drum 1 is kept at a constant rate and the sensor 4 is placed at a fixed position opposed to the drum 1. In view of this, the sensor 4 is capable of measuring the toner density at the same position on the drum 1 by setting the periods T1, T2 even in the case where the toner density is measured a plurality of times.

Figure 5:
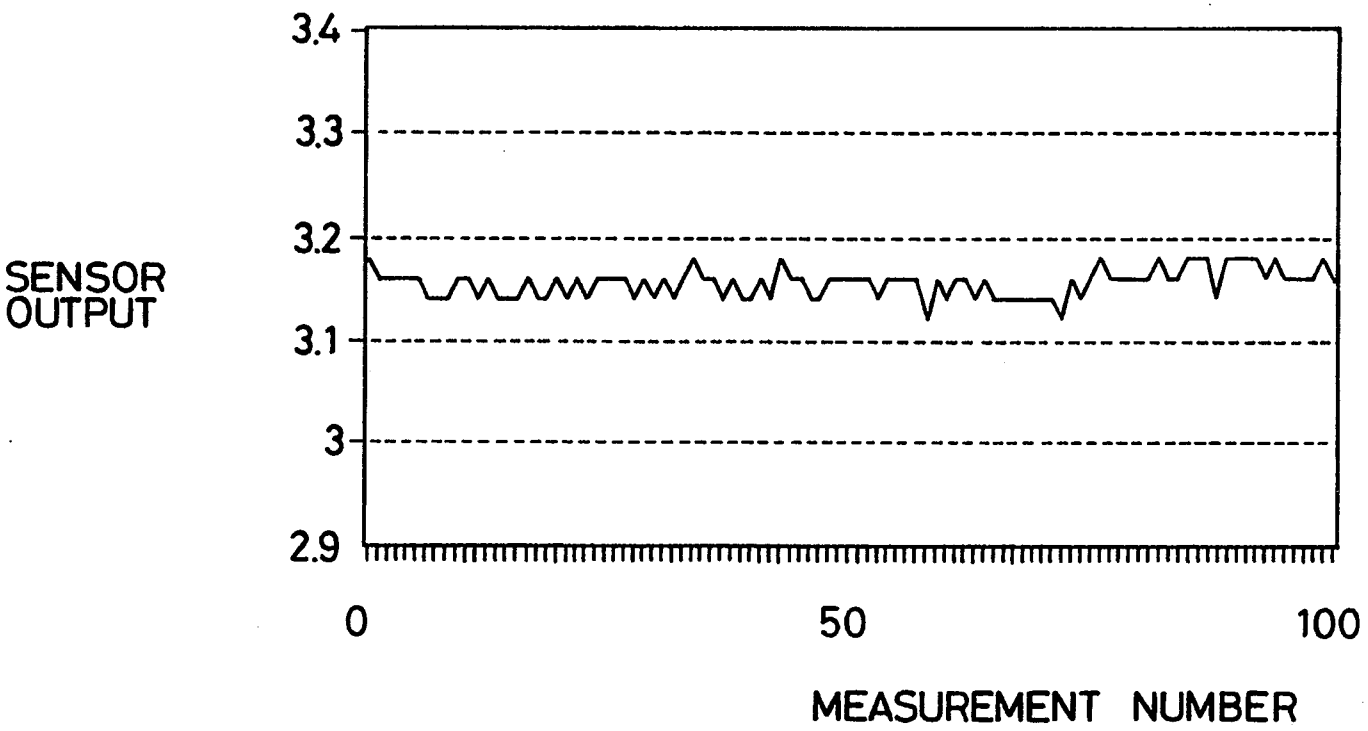
FIG. 5 is a graph showing a sensor output when the toner density is measured continuously in the first embodiment.

With the above arrangement, the toner density can be detected at the same position on the drum 1 during the toner density measurement. Thus, the toner density can be detected without being influenced by changes in measurement conditions such as a change in the detection distance between the drum 1 and the sensor 4 due to the nonuniformity of the surface of the drum 1 and according to the rotation of the drum 1. Therefore, as shown in FIG. 5, the variation of the sensor output can be suppressed to a minimum possible level.

In the first embodiment, the toner density is detected within a certain region on the surface of the drum 1. However, it may be also appropriate to detect an angular rotational position of the drum 1 using a timer in the controller 21 to form toner images at a plurality of positions on the drum 1 in the circumferential direction thereof, and to detect the toner density of each toner image. In other words, the detection timing of the sensor 4 is measured by the timer in the controller 21. The toner image can be detected at a plurality of positions after the rotation reference position indicia 20 is detected by the position sensor 19. This procedure is shown in FIG. 6.

Figure 6:
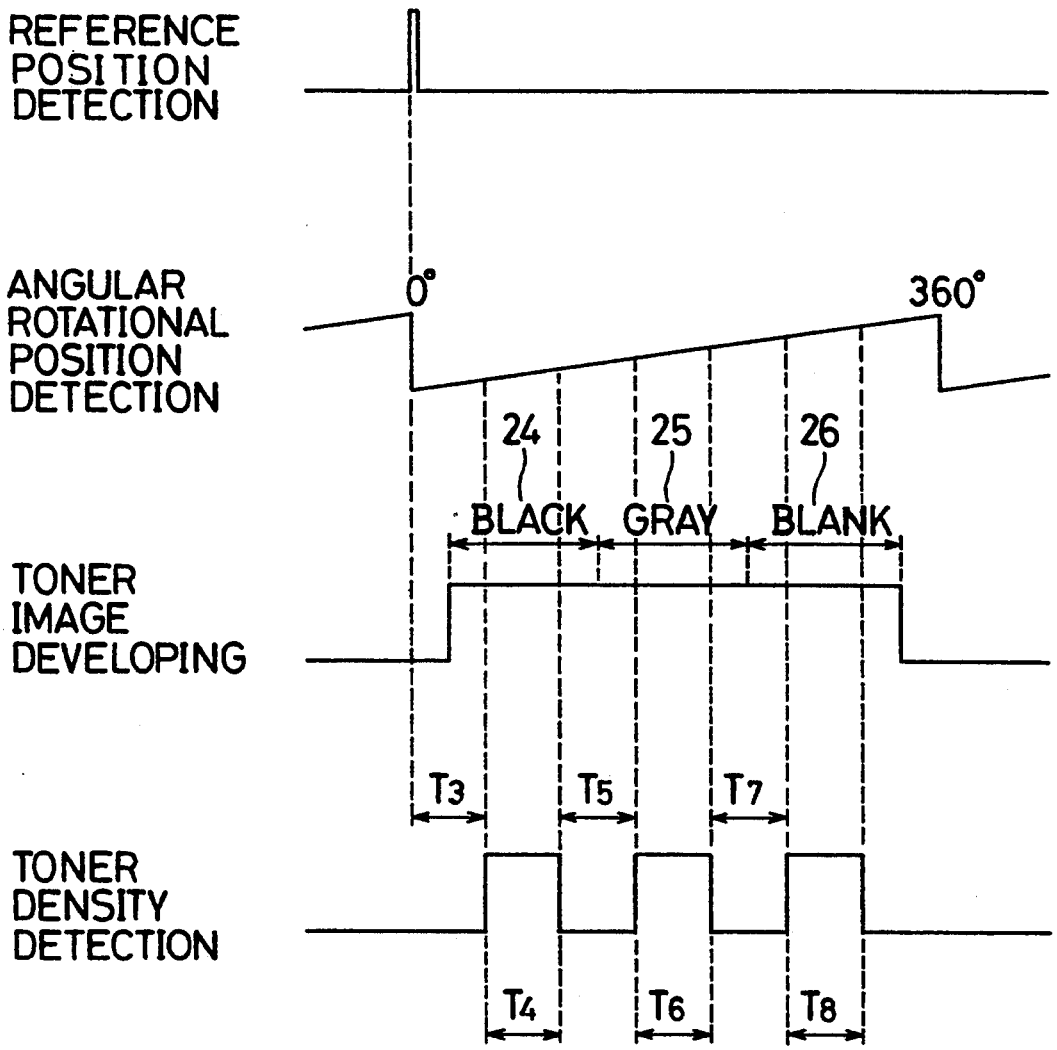
FIG. 6 is a timing chart showing another procedure of measuring the toner density in the first embodiment.

In this case, as shown in FIG. 6, a test document carrying a plurality of image of different reference densities (black portion 24, gray portion 25, blank portion 26) may be used. The toner density of the toner image corresponding to the black portion 24 is detected for a period T4 after the timer in the controller 21 measures a period T3 following the detection of the rotation reference position indicia 20. Thereafter, the toner density of the toner image corresponding to the gray portion 25 is detected for a period T6 after the lapse of a period T5 following the completion of the detection of the black portion 24. Finally, the toner density of the toner image corresponding to the blank portion 26 is detected for a period T8 after the lapse of a period T7 following the completion of the detection of the gray portion 25. If the driving of the sensor 4 is controlled in this manner, the toner density can be measured for a plurality of reference densities during one scanning of the optical assembly, and the respective reference densities can be measured constantly at the same positions on the drum 1 for a plurality of measurements.

Figure 7:
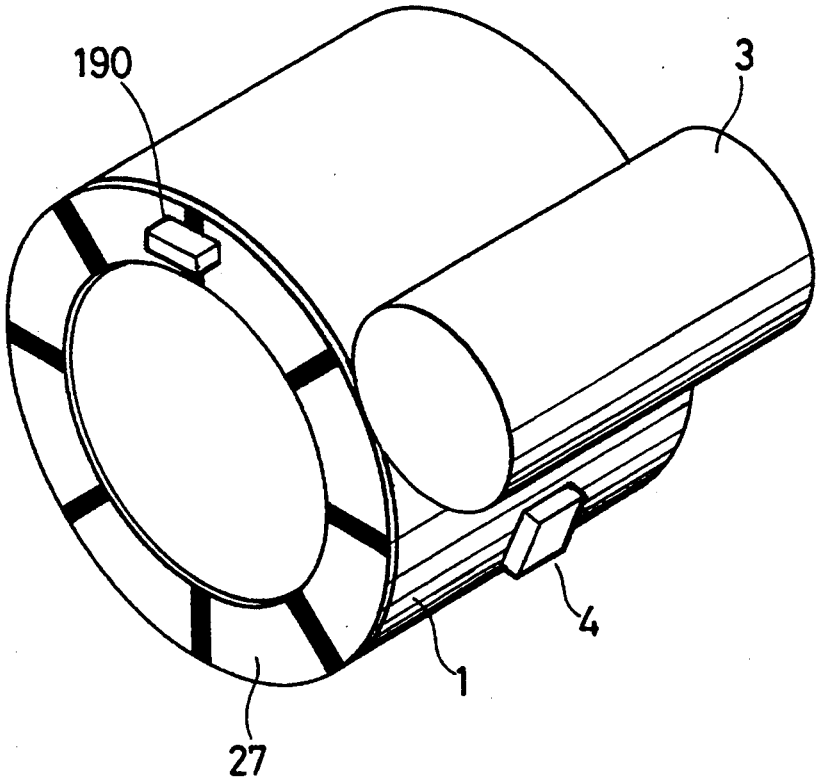
FIG. 7 is a perspective view showing a positional relationship between a photosensitive drum and a sensor in a second copying machine embodying the invention.
Figure 8:
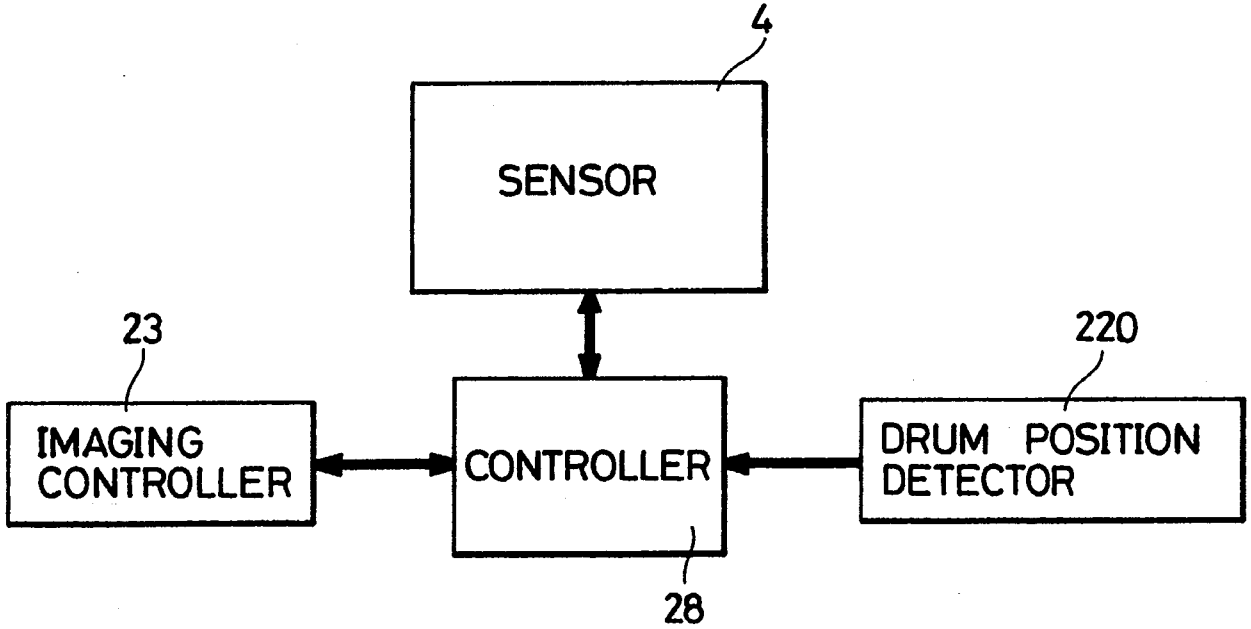
FIG. 8 is a block diagram showing a control system of the second copying machine.
Figure 9:
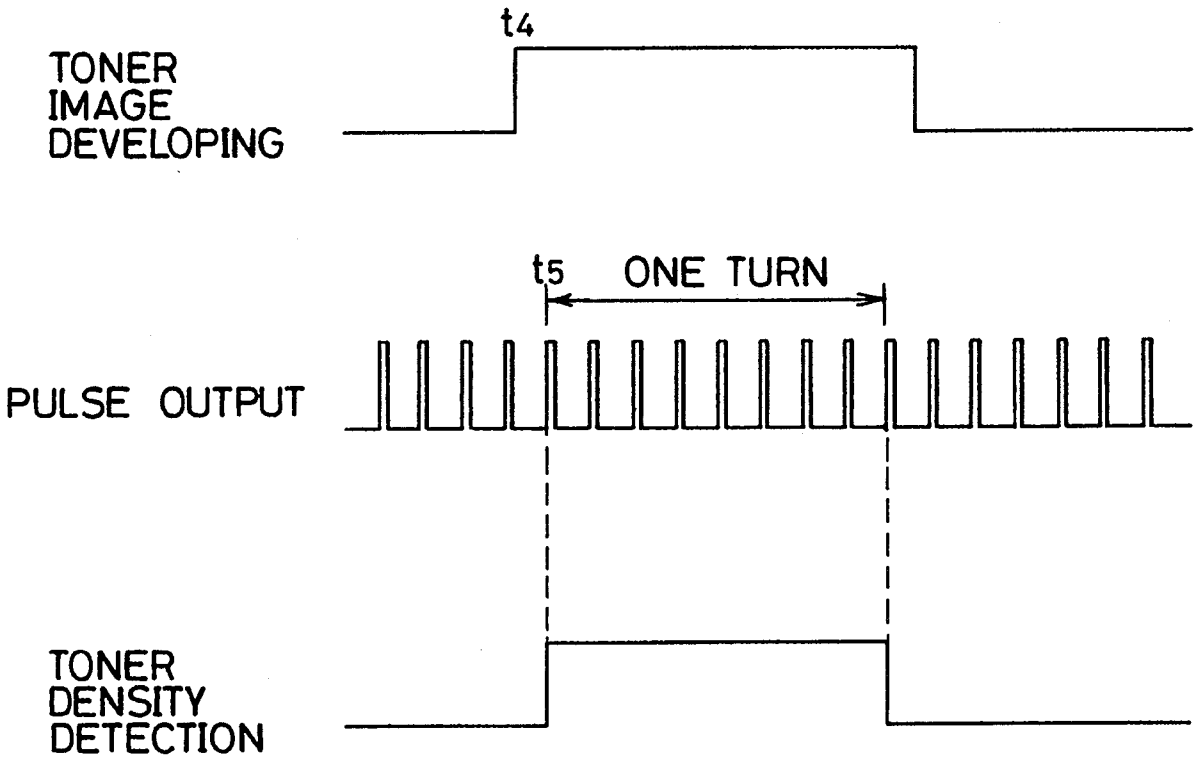
FIG. 9 is a timing chart showing a procedure of measuring the toner density in the second embodiment.

A second embodiment of the invention will be described next with reference to FIGS. 7 to 9. It will be appreciated that like reference numerals designates parts shown in the first embodiment and having like or identical functions. FIG. 7 is a perspective view showing a positional relationship between a photosensitive drum 1 and a sensor 4, and FIG. 8 is a block diagram showing an essential portion of a control system of a copying machine as a second embodiment of the invention. The construction and control system of the copying machine as the second embodiment are substantially similar to those of the first embodiment.

On a side surface of the drum 1 is provided a pulse plate 27 in place of the rotation reference position indicia 20. The pulse plate 27 has a plurality of markings defined thereon, and is rotatable together with the drum 1. A position sensor 190 includes, for example, a reflection type optical sensor, and detects the markings of the pulse plate 27. A drum position detector 220 consists essentially of the position sensor 190 and the pulse plate 27, and outputs a detection signal to a controller 28 each time detecting the marking of the pulse plate 27.

The controller 28 includes a microcomputer or the like, and is adapted for controlling an operation of the copying machine and detecting a rotation amount of the drum 1 in accordance with the detection signal from the drum position detector 220. The controller 28 receives the output from the sensor 4 which detects the toner density and computes the detected toner density to set the necessary imaging conditions.

An imaging controller 23 controls in response to a control signal from the controller 28 such that a charging operation or an exposing operation with a specified light amount is started from a preset position on the drum 1 when the drum position detector 220 detects the marking of the pulse plate 27.

There will be described a measurement procedure of the sensor 4 next with reference to a timing chart shown in FIG. 9. Similar to the first embodiment, the toner density measurement is made using a special test document carrying, for example, an image of a reference density, and is started by operating an operation key such as an image density measurement mode key.

Upon the start of the measurement, the drum 1 starts rotating and has the surface thereof charged at a specified potential by the charger 2. In addition, an optical assembly 9 is caused to scan and thereby an electrostatic latent image is formed on the drum 1. At time t4, a developing device 3 starts developing the latent image.

When the position sensor 190 outputs a first detection signal at time t5 following time t4 as the drum rotates, the sensor 4 starts detecting the toner density of the toner image formed on the drum 1. Upon the output of the detection signal which indicates just one turn of the drum 1, the sensor 4 completes the detection in synchronism with this detection signal. The sensor 4 detects the toner density in synchronism with a clock signal from the controller 28 to produce a plurality of discrete density data while the drum 1 makes one turn.

Being fixed at suitable position opposed to the surface of the drum 1, the sensor 4 is capable of detecting the toner density over the entire circumferential surface of the drum 1 within a specified region in accordance with the detection signals received according to the rotation of the drum 1.

Figure 10:
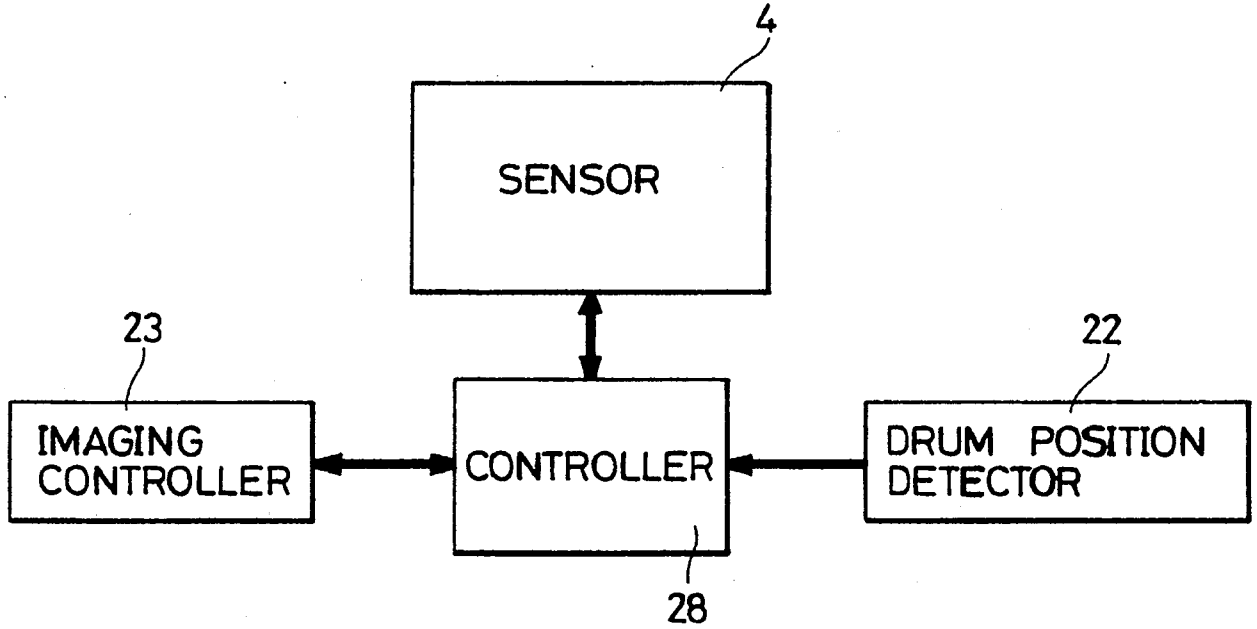
FIG. 10 is a block diagram showing a control system of a third copying machine embodying the invention.

A third embodiment of the invention will be described next with reference to a block diagram shown in FIG. 10. It will be appreciated that like reference numerals designate parts shown in the first and second embodiments and having like or identical functions. The construction and control system of a third copying machine embodying the invention are substantially similar to those of the second embodiment.

There will be described a measurement procedure of a sensor 4. Similar to the second embodiment, the toner density measurement is made using a special test document carrying, for example, an image of a reference density, and is started by operating an operation key such as an image density measurement mode key.

Upon the start of the measurement, the drum 1 starts rotating and has the surface thereof charged at a specified potential by a charger 2. In addition, an optical assembly 9 is caused to scan and thereby an electrostatic latent image is formed on the drum 1. As the drum 1 rotates, a rotation reference position indicia 20 is detected by a position sensor 19 which outputs a detection signal to a controller 28. Simultaneously, the sensor 4 starts detecting the toner density of a toner image formed on the drum 1. When the rotation reference position indicia 20 is detected by the position sensor 19 again as the drum 1 rotates, the sensor 4 completes the detection.

Being located at a fixed position opposed to the surface of the drum 1, the sensor 4 is capable of detecting the toner density over the entire circumferential surface of the drum 1 within a specified region in accordance with the detection of the rotation reference position indicia 20 of the drum 1 similar to the second embodiment.

Figure 11:
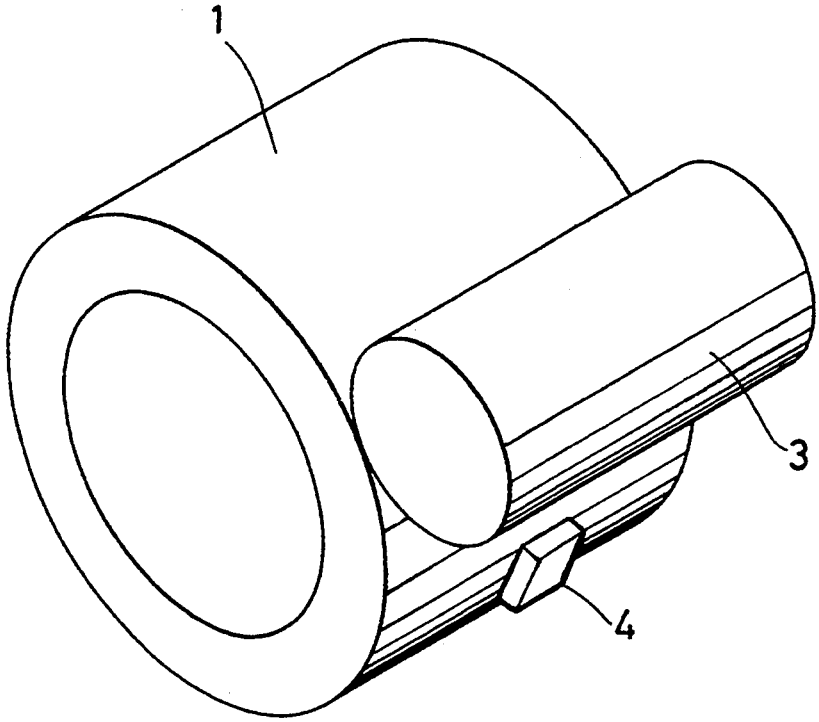
FIG. 11 is a perspective view showing a positional relationship between a photosensitive drum and a sensor in a fourth copying machine embodying the invention.
Figure 12:
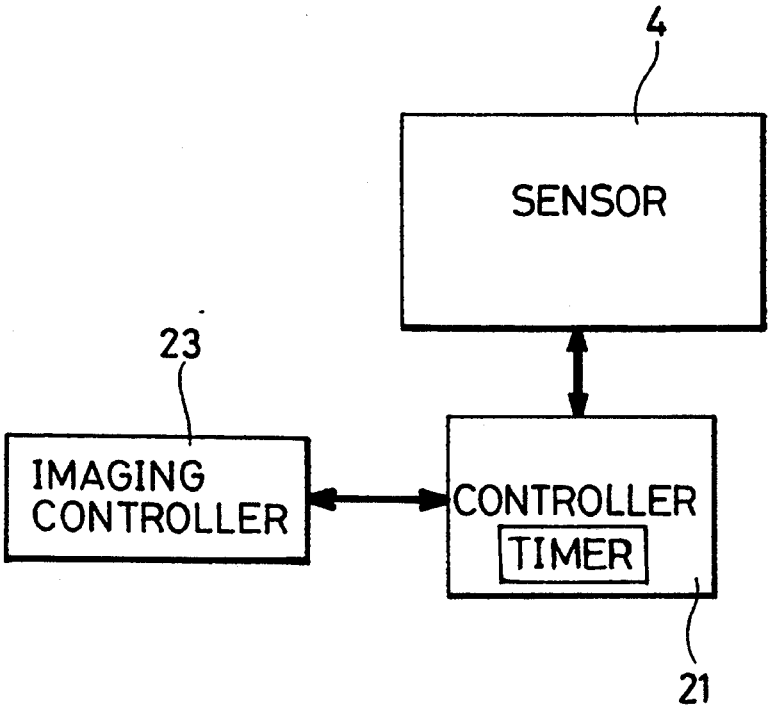
FIG. 12 is a block diagram showing a control system of the fourth copying machine.
Figure 13:
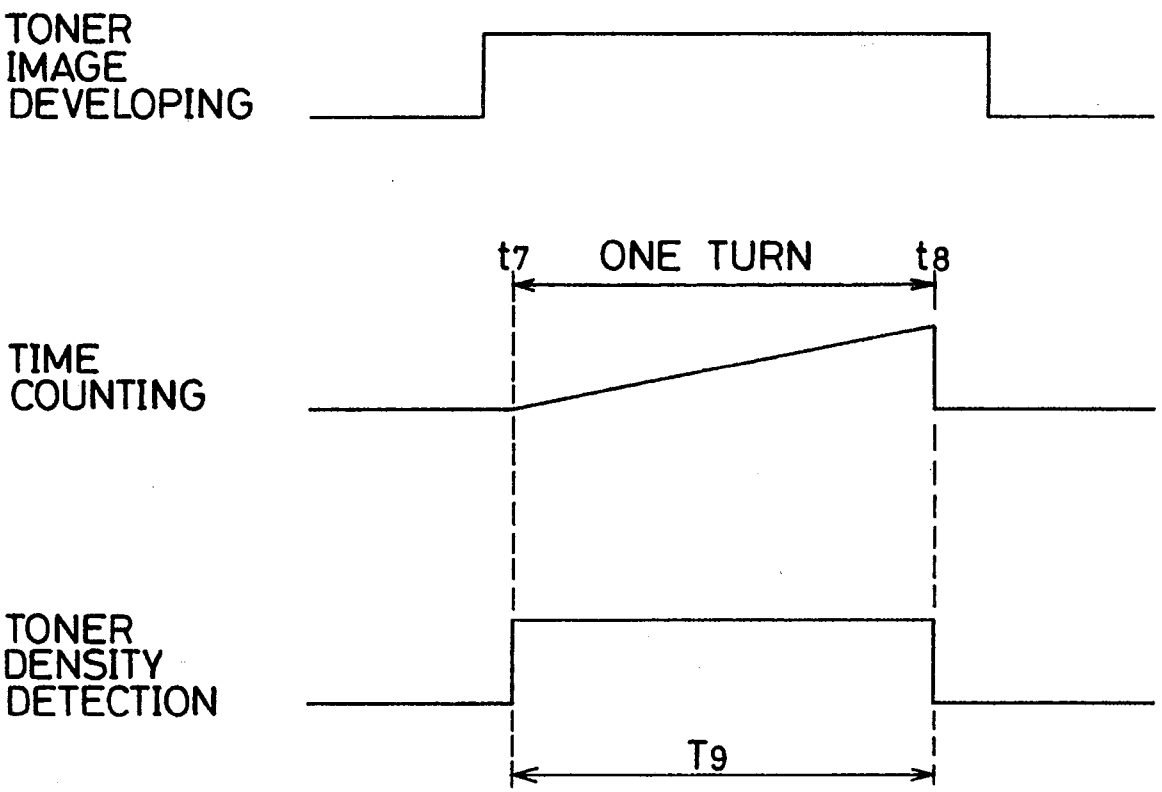
FIG. 13 is a timing chart showing a procedure of measuring the toner density in the fourth embodiment.

A fourth embodiment of the invention will be described next with reference to FIGS. 11 to 13. It will be appreciated that like reference numerals designate parts shown in the first embodiment and having like or identical functions. FIG. 11 is a perspective view showing a positional relationship between a photosensitive drum 1 and a sensor 4, and FIG. 12 is a block diagram showing a control system of fourth copying machine embodying the invention.

The construction and control system of the fourth copying machine are substantially similar to those of the first embodiment. In the fourth embodiment, the drum position detector 22 is not provided.

A controller 21 includes a microcomputer or the like, and controls an operation of the copying machine. The controller 21 is provided with a timer used to detect a rotation amount of the drum 1 based on a preset rotating speed thereof. The controller 21 renders the sensor 4 detect the toner density to set necessary imaging conditions by computation of the detected toner density.

There will be described a measurement procedure of the sensor 4 next with reference to a timing chart shown in FIG. 13. Similar to the first embodiment, the toner density measurement is made using a special test document carrying, for example, an image of a reference density, and is started by operating an operation key such as an image density measurement mode key.

Upon the start of the measurement, the drum 1 starts rotating and has the surface thereof charged at a specified potential by a charger 2. In addition, an optical assembly 9 is caused to scan and thereby an electrostatic latent image is formed on the drum 1. Upon the lapse of a preset period, the sensor 4 starts detecting the toner density at time t7 and the timer in the controller 21 is started. After the lapse of a period T9 corresponding to one turn of the drum 1, the sensor 4 stops detecting the toner density at time t8.

In this way, since the sensor 4 is located at the fixed suitable position opposed to the drum 1 and the timer in the controller 21 measures a period during which the drum 1 makes one turn, the sensor 4 is capable of detecting the toner density over the entire circumferential surface of the drum 1 within a specified region.

Figure 14:
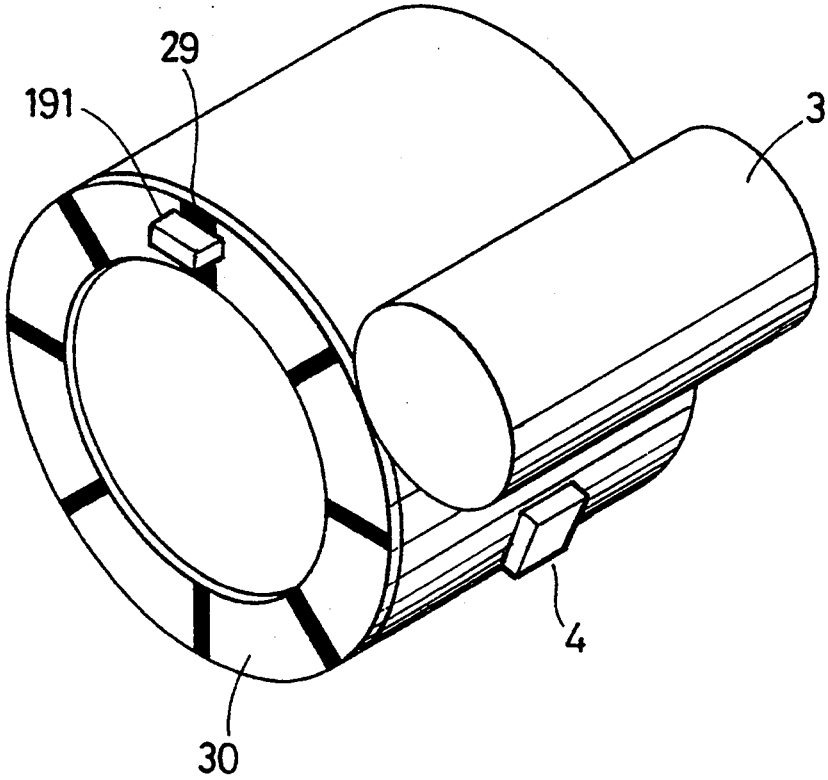
FIG. 14 is a perspective view showing a positional relationship between a photosensitive drum and a sensor in a fifth copying machine embodying the invention.
Figure 15:
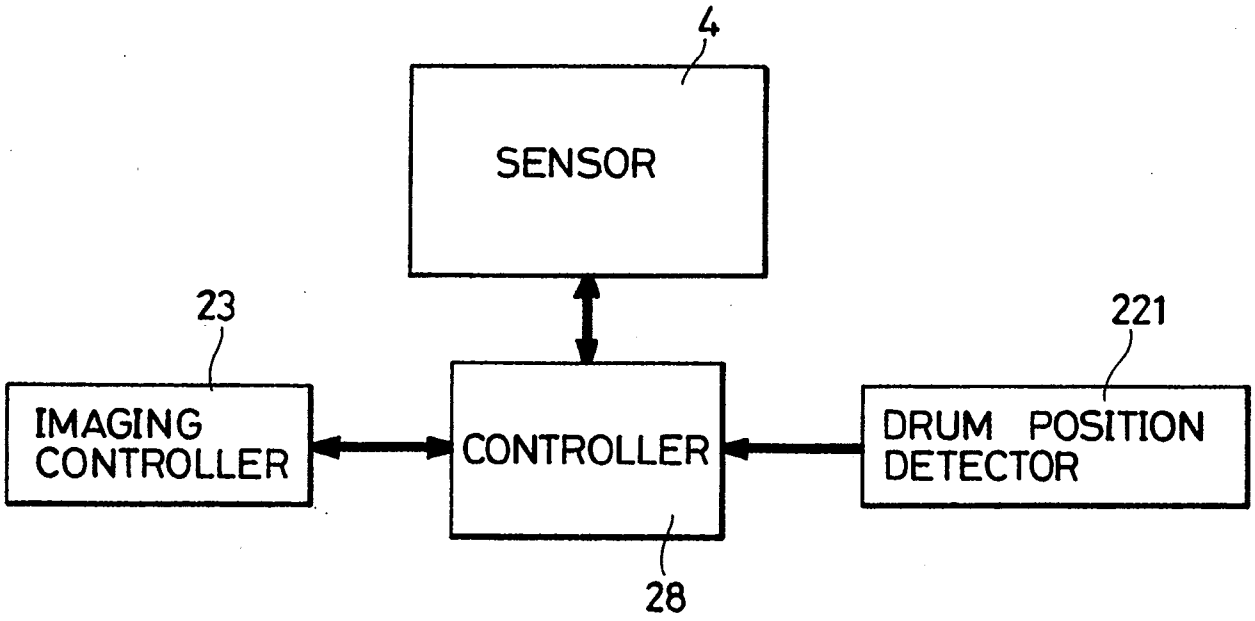
FIG. 15 is a block diagram showing a control system of the fifth copying machine.
Figure 16:
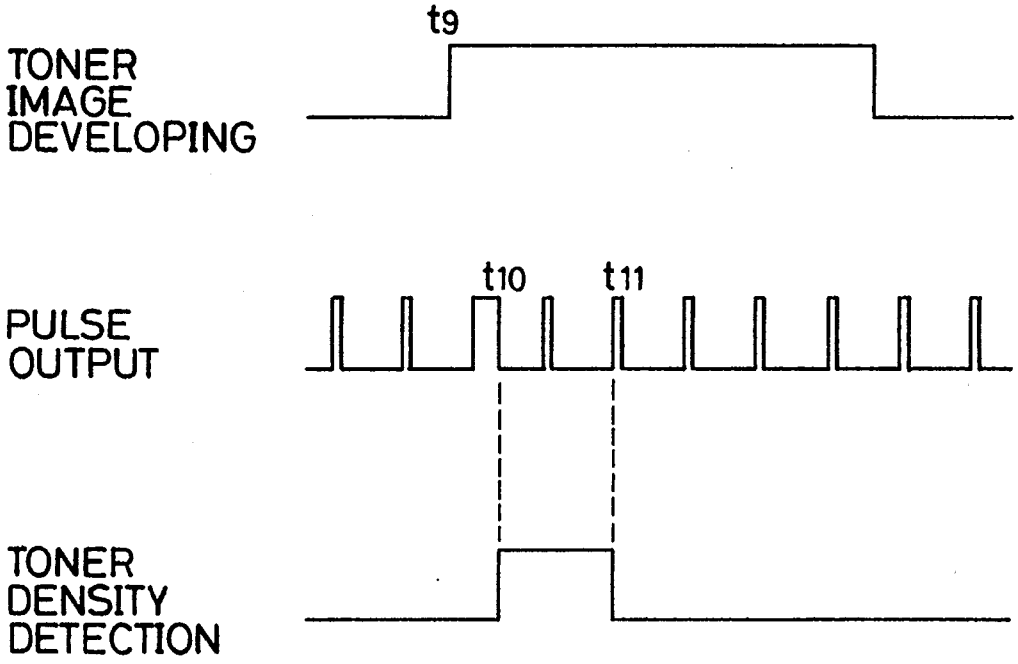
FIG. 16 is a timing chart showing a procedure of measuring the toner density in the fifth embodiment.
Figure 17A:
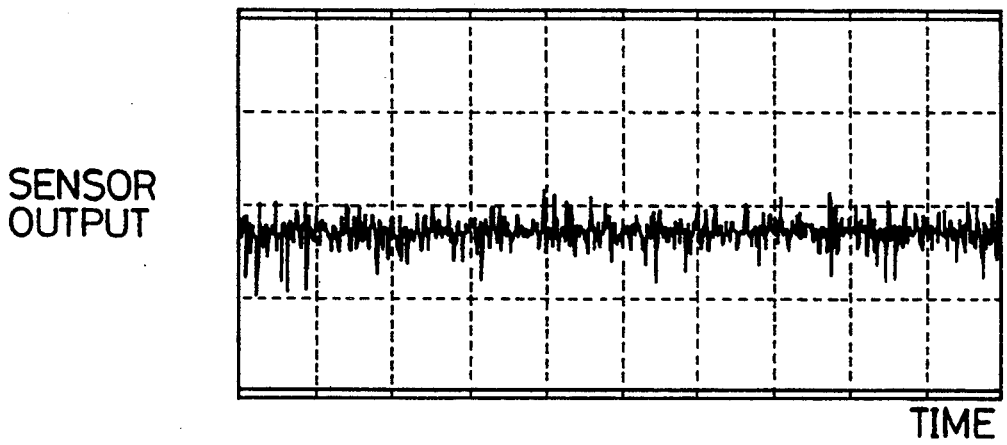
FIG. 17A PRIOR ART
FIG. 17A is a graph showing a sensor output over time when the toner density is detected while the photosensitive member is stationary.
Figure 17B:
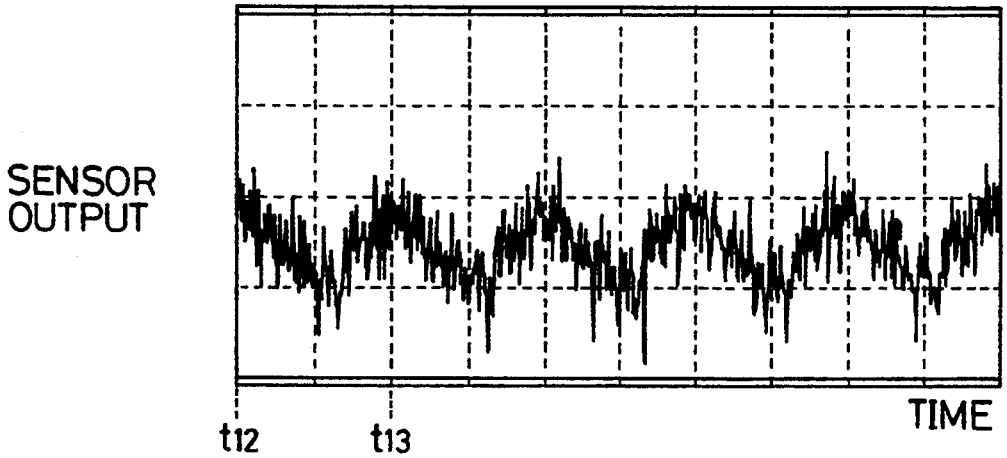
FIG. 17B PRIOR ART
FIG. 17B is a graph showing a sensor output over time while the photosensitive member is rotating.
Figure 17C:
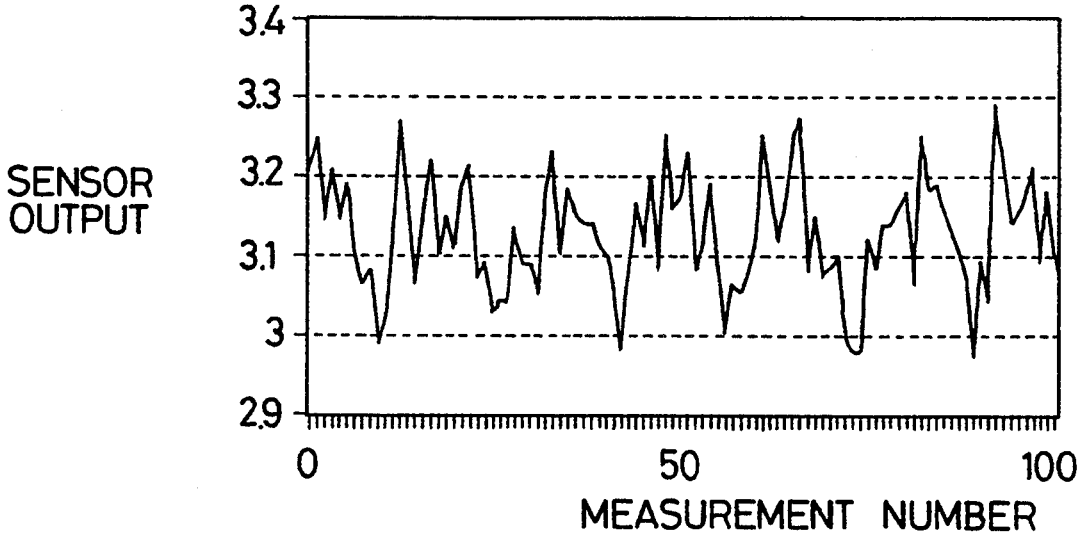
FIG. 17C PRIOR ART
FIG. 17C is a graph showing a sensor output when a sampling is carried out continuously so as to measure the toner density while the photosensitive member is rotating.

A fifth embodiment of the invention will be described next with reference to FIGS. 14 to 16. It will be appreciated that like reference numerals designate parts shown in the first and second embodiments and having like or identical functions. FIG. 14 is a perspective view showing a positional relationship between a photosensitive drum 1 and a sensor 4 in the fifth embodiment, and FIG. 15 is a block diagram showing a control system of a fifth copying machine embodying the invention. The construction and control system of the fifth copying machine are substantially similar to those of the first embodiment.

On a side surface of the drum 1 is provided a pulse plate 30 in place of the rotation reference position indicia 20. The pulse plate 30 has a plurality of markings defined thereon, and is rotatable together with the drum 1. One of the markings is distinguishable as a drum reference position marking 29 over the other markings. A position sensor 191 includes, for example, a reflection type optical sensor, and detects the respective markings of the pulse plate 30.

A drum position detector 221 consists essentially of the position sensor 191 and the pulse plate 30, and outputs a detection signal to a controller 28 each time detecting the drum reference position marking 29 and the other markings of the pulse plate 30. The controller 28 detects a reference position and a rotation amount of the drum 1 in accordance with the detection signal from the drum position detector 221.

There will be described a measurement procedure of the sensor 4 next with reference to a timing chart shown in FIG. 16. Similar to the first embodiment, the toner density measurement is made using a special test document carrying, for example, an image of a reference density, and is started by operating an operation key such as an image density measurement mode key.

Upon the start of the measurement, the drum 1 starts rotating and has the surface thereof charged at a specified potential by a charger 2. In addition, an optical assembly 9 is caused to scan and thereby an electrostatic latent image is formed on the drum 1. At time t9, a developing device 3 starts developing the latent image. When the detection signal of the drum reference position indicia 29 is sent from the position sensor 191 as the drum 1 rotates, the sensor 4 starts detecting the toner density of a toner image formed on the drum 1 at time t10. Upon the detection of a predetermined number of markings of the pulse plate 30, the sensor 4 completes the detection in synchronism with the detection signal at time t11.

As seen from the above, the rotating speed of the drum 1 is kept at a constant rate and the sensor 4 is located at a fixed suitable position opposed to the drum 1. Accordingly, the toner density can be measured at the same position on the drum 1 by setting in advance the number of markings of the pulse 30 to be counted until the density detection by the sensor 4 is completed after the detection of the drum reference position indicia 29.

In the first and fifth embodiments, the sensor 4 is capable of detecting the toner density during a shorter period of time and with a smaller amount of toner compared to the second to fourth embodiments because it detects the toner density at a specific position on the drum 1. These two embodiments are also advantageous in their capability to form the toner images of a plurality of densities on the circumferential surface of the drum 1 and to detect the toner density of each of them.

On the other hand, the second to fourth embodiments are advantageous in their simpler construction compared to the first and fifth embodiments because only either the position detector means for the drum 1 or the timer is provided.

In the foregoing embodiments, the sensor 4 detects directly the toner density of the toner image formed on the drum 1. However, the sensor 4 may be a potential sensor for detecting the potential of an electrostatic latent image formed on the drum 1, so as to predict the toner density based on the detected potential. Further, the foregoing embodiments are described with respect to an image forming apparatus including a photosensitive member in the form of drum. However, it goes without saying that the invention is also applicable to an image forming apparatus including a photosensitive member in the form of a belt.

Moreover, the toner density measurement is made by operating the image density measurement mode key or the like. However, the toner density may be measured automatically during a very short period when the copying machine is powered on or immediately after a copy start key is turned on.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. An image forming apparatus comprising:

a photosensitive member rotatable at a fixed speed in a specified direction;

imaging means for forming a toner image on a surface of the photosensitive member, the imaging mean including:

charger means for charging a surface of the photosensitive member;

exposure means for exposing the charged surface of the photosensitive member to a light image to form an electrostatic latent image on the charged surface of the photosensitive member; and developer means for developing the electrostatic latent image to a toner image;

image forming controller means for forming a reference toner image on the surface of the photosensitive member, the image forming controller means controlling the imaging means to charge the surface of the photosensitive member, to expose the charged surface to a reference light image to form an electrostatic latent image, and to develop the electrostatic latent image to said reference toner image;

a sensor provided after the developer means with respect to the rotational direction of the photosensitive member for detecting the toner density of the reference toner image;

a reference indicia provided on the photosensitive member for indicating a reference position;

a detector for detecting the reference indicia;

a timer responsive to the detector for measuring time; and a controller responsive to the image forming controller means and the detector for controlling the sensor to execute the toner density detection of the reference toner image for a predetermined time after the reference toner image has been formed and the reference indicia has been detected by the detector.

2. An image forming apparatus according to claim 1 wherein the sensor is an optical sensor.

3. An image forming apparatus according to claim 1 wherein the reference toner image is formed on a whole circumferential surface of the photosensitive member.

4. An image forming apparatus according to claim 1 wherein said sensor is operable to execute the toner density detection of the reference toner image on a same region of the photosensitive member for repeated rotations of said photosensitive member.

5. An image forming apparatus according to claim 4 wherein said sensor is operable to produce a plurality of discrete toner density data of said region of the photosensitive member, said controller averaging out said data to produce an averaged value.

6. An image forming apparatus according to claim 1 wherein said image forming controller means forms said reference toner image on the photosensitive member using a test document.

7. An image forming apparatus comprising:

a photosensitive member rotatable at a fixed speed in a specified direction;

imaging means for forming a toner image on a surface of the photosensitive member, the imaging mean including:

charger means for charging the surface of the photosensitive member;

exposure means for exposing the charged surface of the photosensitive member to a light image to form an electrostatic latent image on the charged surface of the photosensitive member; and developer means for developing the electrostatic latent image to a toner image;

image forming controller means for forming a reference toner image on the surface of the photosensitive member, the image forming controller means controlling the imaging means to charge the surface of the photosensitive member, to expose the charged surface to a reference light image to form an electrostatic latent image, and to develop the electrostatic latent image to said reference toner image;

a sensor provided after the developer means with respect to the rotational direction of the photosensitive member for detecting a toner density of the reference toner image;

a start indicia provided on the photosensitive member for indicating a detection start position;

a finish indicia provided on the photosensitive member for indicating a detection finish position;

a detector for detecting the start and finish indicia; and a controller responsive to the image forming controller means and the detector for controlling the sensor to start the toner density detection after the formation of the reference toner image has been started and the start indicia has been detected by the detector, and to stop the toner density detection upon the finish indicia being detected by the detector.

8. An image forming apparatus according to claim 7 wherein the sensor is an optical sensor.

9. An image forming apparatus according to claim 7 wherein the reference toner image is formed on a whole circumferential surface of the photosensitive member.

10. An image forming apparatus according to claim 7 wherein said sensor is operable to execute the toner density detection of the reference toner image on a same region of the photosensitive member for repeated rotations of said photosensitive member.

11. An image forming apparatus according to claim 10 wherein said sensor is operable to produce a plurality of discrete toner density data of said region of the photosensitive member, said controller averaging out said data to produce an averaged value.

12. An image forming apparatus according to claim 7 wherein said image forming controller means forms said reference toner image on the surface of the photosensitive member using a test document.

13. An image forming apparatus comprising:

a photosensitive member rotatable at a fixed speed in a specified direction;

imaging means for forming a toner image on a surface of the photosensitive member, the imaging mean including:

charger means for charging a surface of the photosensitive member; and exposure means for exposing the charged surface of the photosensitive member to a light image to form an electrostatic latent image on the charged surface of the photosensitive member;

image forming controller means for forming a reference image, the image forming controller means controlling the imaging means to charge a whole circumferential surface of the photosensitive member, and exposing the whole circumferential surface to a reference light image to form a reference electrostatic latent image; and detecting means responsive to the image forming controller means for detecting an image state on the whole circumferential surface of the photosensitive member.

14. An image forming apparatus according to claim 13 wherein the detecting means includes:

a sensor for detecting an imaging state on a surface of the photosensitive member;

a reference indicia provided on the photosensitive member for indicating a detection reference position;

a detector for detecting the reference indicia; and a controller for controlling the sensor to start the imaging state detection after the formation of the reference electrostatic latent image has been started and the reference indicia has been detector by the detector, and to stop the imaging state detection upon the reference indicia being detected again.

15. An image forming apparatus according to claim 13 wherein the detecting means includes:

a sensor for detecting an imaging state on a surface of the photosensitive member;

a memory for storing a time required for the photosensitive member to make one turn;

a timer for measuring time, the timer starting at the same time as the start of said imaging state detection; and a controller for controlling the sensor to start the imaging state detection at a predetermined time after starting the formation of the reference electrostatic latent image, and to stop the imaging state detection upon the time measuring the one-turn required time stored in the memory.

16. An image forming apparatus according to claim 13 wherein:

the imaging means further comprising developer means provided after the exposure means with respect to the rotational direction of the photosensitive member for developing the electrostatic latent image to a reference toner image; and the detecting means includes a sensor provided after the developer means with respect to the rotational direction of the photosensitive member for detecting a toner density of the reference toner image.

17. An image forming apparatus according to claim 16 wherein the detecting means includes an optical sensor.

* * * * *